US011607055B2

(12) United States Patent
Hu et al.

(10) Patent No.: US 11,607,055 B2
(45) Date of Patent: Mar. 21, 2023

(54) ELECTRICALLY CONTROLLED CHASSIS AND CHAIR

(71) Applicant: Comfort Office Furniture Co., Ltd Guangdong, Guangzhou (CN)

(72) Inventors: Guoqiang Hu, Guangzhou (CN); Min Zhang, Guangzhou (CN)

(73) Assignee: COMFORT OFFICE FURNITURE CO., LTD GUANGDONG, Guangzhou (CN)

( * ) Notice: Subject to any disclaimer, the term of this patent is extended or adjusted under 35 U.S.C. 154(b) by 0 days.

(21) Appl. No.: 17/540,425

(22) Filed: Dec. 2, 2021

(65) Prior Publication Data

US 2022/0378220 A1 Dec. 1, 2022

(30) Foreign Application Priority Data

May 27, 2021 (CN) ..... 202110583062.X

(51) Int. Cl.

| | |
|---|---|
| ***A47C 1/032*** | (2006.01) |
| ***A47C 3/20*** | (2006.01) |
| ***A47C 7/14*** | (2006.01) |
| ***A47C 7/44*** | (2006.01) |
| ***A47C 31/00*** | (2006.01) |
| ***A47C 7/00*** | (2006.01) |

(52) U.S. Cl.

CPC ..... *A47C 31/008* (2013.01); *A47C 3/20* (2013.01); *A47C 7/004* (2013.01); *A47C 7/441* (2013.01)

(58) Field of Classification Search

CPC ..... A47C 3/20; A47C 7/004; A47C 7/441; A47C 31/008

See application file for complete search history.

(56) References Cited

U.S. PATENT DOCUMENTS 5,354,120 A * 10/1994 Volkle ..... A47C 1/03255 297/300.1
5,397,111 A 3/1995 Knopp
6,053,574 A * 4/2000 Opsvik ..... A47C 3/026 297/303.2

(Continued)

FOREIGN PATENT DOCUMENTS

CN 113729428 A * 12/2021 ..... A47C 3/20
CN 114246431 A * 3/2022 ..... A47C 7/004

(Continued)

OTHER PUBLICATIONS

European Search Report dated Jul. 1, 2022; EP 21217037.7.

*Primary Examiner* — Rodney B White
(74) *Attorney, Agent, or Firm* — Ipro, PLLC

(57) ABSTRACT

An electrically controlled chassis includes: a chassis body; an electrical control box, internally provided with an accommodation space; a drive motor, configured to control lift adjustment of the chassis of the chair and pitch adjustment of a backrest of the chair; a winding mechanism, connected to an output shaft of the drive motor; a first pull cord, reversely wound on the winding mechanism; a second pull cord, normally wound on the winding mechanism; a backrest adjustment mechanism, disposed on the chassis body, and fixedly connected to the other end of the first pull cord; and a chassis lift mechanism, disposed on the chassis body, and fixedly connected to the other end of the second pull cord.

20 Claims, 8 Drawing Sheets

(56) References Cited

U.S. PATENT DOCUMENTS

| | | | | |
|---|---|---|---|---|
| 8,414,075 | B2 * | 4/2013 | Ko | A47C 1/03266 297/302.6 |
| 8,556,345 | B2 * | 10/2013 | Huang | A47C 1/03255 297/303.4 |
| 9,386,858 | B2 * | 7/2016 | Chen | A47C 1/024 |
| 9,402,479 | B1 * | 8/2016 | Lin | A47C 1/0355 |
| 10,383,448 | B1 * | 8/2019 | VerBeek | A47C 1/03255 |
| 10,653,249 | B2 * | 5/2020 | Schmitz | A47C 31/126 |
| 10,682,271 | B2 * | 6/2020 | Lin | A47C 7/5068 |
| 11,166,569 | B2 * | 11/2021 | Schmitz | A47C 31/126 |
| 2004/0195883 | A1 * | 10/2004 | Vrijlandt | A47C 1/03266 297/303.4 |
| 2013/0069408 | A1 * | 3/2013 | Chen | A47C 1/03205 297/337 |
| 2016/0327071 | A1 | 11/2016 | Hosan et al. | |

FOREIGN PATENT DOCUMENTS

| | | | | | |
|---|---|---|---|---|---|
| EP | 3672451 | B1 | | 12/2020 | |
| TW | M535026 | U | * | 1/2017 | A47C 7/441 |
| WO | WO-2021237811 | A1 | * | 12/2021 | A47C 3/18 |

* cited by examiner

ELECTRICALLY CONTROLLED CHASSIS AND CHAIR

CROSS REFERENCE TO RELATED APPLICATIONS

The present disclosure claims priority to Chinese Patent Application No. 202110583062.X, filed with the Chinese Patent Office on May 27, 2021, titled "ELECTRICALLY CONTROLLED CHASSIS AND CHAIR", the entire contents of which are incorporated herein by reference.

TECHNICAL FIELD

Embodiments of the present disclosure relate to the technical field of chair adjustment and control devices, and in particular, relate to an electrically controlled chassis and a chair.

BACKGROUND

In a conventional chair, lift adjustment of a chassis of the chair and pitch adjustment of a backrest of the chair are mechanically and manually achieved. Therefore, the chassis of the chair has a complicated internal control structure, and is thus difficult to operate.

SUMMARY

In view of the above problem, embodiments of the present disclosure provide an electrically controlled chassis and a chair, such that an adjustment mechanism for lift adjustment of the chassis of the chair and pitch adjustment of a backrest of the chair is simplified, and operation convenience is improved.

According to one aspect of the embodiments of the present disclosure, an electrically controlled chassis is provided. The electrically controlled chassis is applicable to adjustment of a chair. The electrically controlled chassis includes: a chassis body; an electrical control box, disposed on the chassis body, and internally provided with an accommodation space; a drive motor, disposed in the accommodation space of the electrical control box, and configured to control lift adjustment of the chassis of the chair and pitch adjustment of a backrest of the chair; a winding mechanism, connected to an output shaft of the drive motor, and being rotatable with the output shaft of the drive motor; a first pull cord, reversely wound on the winding mechanism, and one end of the first pull cord being fixedly connected to the winding mechanism; a second pull cord, normally wound on the winding mechanism, and one end of the second pull cord being fixedly connected to the winding mechanism; a backrest adjustment mechanism, disposed on the chassis body, and fixedly connected to the other end of the first pull cord, wherein in the case that the output shaft of the drive motor drives the winding mechanism to rotate along a first direction, the first pull cord is pulled such that the backrest adjustment mechanism is adjustable; and a chassis lift mechanism, disposed on the chassis body, and fixedly connected to the other end of the second pull cord, wherein in the case that the output shaft of the drive motor drives the winding mechanism to rotate along a second direction, the second pull cord is pulled such that the chassis lift mechanism is adjustable.

In an optionally embodiment, the electrically controlled chassis further includes a wireless signal receiver device, wherein the wireless signal receiver device is disposed in the accommodation space of the electrical control box and electrically connected to the drive motor, and configured to receive a wireless control signal to control operation of the drive motor.

In an optional embodiment, the winding mechanism is provided with a rotation shaft, a baffle being sleeved onto the rotation shaft, the baffle being provided with an opening; wherein a throughbeam photoelectric sensor corresponding to a position of the baffle is disposed in the accommodation space of the electrical control box, the throughbeam photoelectric sensor operates via the opening, and configured to output a control signal to the drive motor.

In an optional embodiment, the chassis lift mechanism includes a pneumatic rod and a rotation stopper, one end of the pneumatic rod being provided with a key valve, and one end of the rotation stopper being rotatably connected to the chassis body, and the other end of the rotation stopper being connected to the second pull cord; wherein in the case that the drive motor drives the second pull cord to move, the second pull cord pulls the rotation stopper to rotate, such that rotation stopper presses the key valve to cause the pneumatic rod to move upward and downward.

In an optional embodiment, the chassis lift mechanism further includes an urging direction adjuster; wherein the urging direction adjuster is disposed at a position, corresponding to the rotation stopper, on the chassis body, and the second pull cord penetrates the urging direction adjuster; and the urging direction adjuster is configured to adjust a movement direction of the second pull cord to be consistent with a tangential direction of a rotation direction of the rotation stopper.

In an optional embodiment, the urging direction adjuster is provided with a catch groove and a wheel, the wheel being disposed opposite to the rotation stopper; wherein the second pull cord is clamped into the catch groove, and wound on the wheel.

In an optional embodiment, the chassis body includes a holder and a backrest support rotatably connected to the holder, and the backrest adjustment mechanism includes a catch block, a locking slider, and a first elastic member; wherein the catch block is disposed on the backrest support; one end of the first elastic member is connected to the holder, and the other end of the first elastic member is connected to the locking slider, and configured to supply an elastic force for sliding towards the catch block to the locking slider; and the locking slider is in limiting fit with the catch block, and configured to limit and adjust the backrest support.

In an optional embodiment, the backrest adjustment mechanism further includes an elastic slider and a second elastic member; wherein the elastic slider is slidably disposed on the holder; one side of the locking slider is provided with a first rack, one end of the elastic slider is provided with a second rack, and the elastic slider locks and limits the locking slider under meshing between the second rack on the elastic slider and the first rack on the locking slider; and one end of the second elastic member is disposed on the holder, and the other end of the second elastic member is connected to the elastic slider, and configured to drive the elastic slider to detach from the locking slider.

In an optional embodiment, the backrest adjustment mechanism further includes an active slider and a third elastic member; wherein the active slider is slidably disposed on the holder and provided with a first slant edge, and the elastic slider is provided with a second slant edge; one end of the active slider is connected to one end of the third elastic member, and the other end of the active slider is connected to the first pull cord; the other end of the third elastic member is connected to the holder, and configured to supply an elastic force for sliding towards the elastic slider to the active slider; and in the case that the first pull cord pulls the active slider to slide, the first slant edge of the active slider detaches from the second slant edge of the elastic slider, and the elastic slider slides towards the active slider under action of the second elastic member, such that the second rack on the elastic slider detaches from the first rack on the locking slider.

In an optional embodiment, the chassis body is provided with a manually controlled handle, wherein the manually controlled handle is connected to the backrest adjustment mechanism and the chassis lift mechanism by a third pull cord and a fourth pull cord, and configured to control the backrest adjustment mechanism and the chassis lift mechanism.

In an optional embodiment, the output shaft of the drive motor is rotatably connected to the winding mechanism via the transmission mechanism.

In an optional embodiment, the transmission mechanism includes one or a plurality of a worm, a turbine, a gear, and a bevel gear, to retard or accelerate the drive motor, and change the direction of a transmission shaft.

In an optional embodiment, the electrical control box is provided with a battery accommodation structure configured to accommodate a battery.

In an optional embodiment, the rotation stopper is provided with a hinge end rotatably connected to the chassis body, and a force receiving end fixedly connected to the second pull cord.

In an optional embodiment, the wheel is disposed at an orthographic projection of the force receiving end on the chassis body, and the second pull cord is clamped into the catch groove and wound on the wheel.

According to another aspect of the embodiments of the present disclosure, a chair is provided. The chair includes the electrically controlled chassis. The electrically controlled chassis is applicable to adjustment of a chair, and the electrically controlled chassis including: a chassis body; an electrical control box, disposed on the chassis body, and internally provided with an accommodation space; a drive motor, disposed in the accommodation space of the electrical control box, and configured to control lift adjustment of the chassis of the chair and pitch adjustment of a backrest of the chair; a winding mechanism, connected to an output shaft of the drive motor, and being rotatable with the output shaft of the drive motor; a first pull cord, reversely wound on the winding mechanism, and one end of the first pull cord being fixedly connected to the winding mechanism; a second pull cord, normally wound on the winding mechanism, and one end of the second pull cord being fixedly connected to the winding mechanism; a backrest adjustment mechanism, disposed on the chassis body, and fixedly connected to the other end of the first pull cord, wherein in the case that the output shaft of the drive motor drives the winding mechanism to rotate along a first direction, the first pull cord is pulled such that the backrest adjustment mechanism is adjustable; and a chassis lift mechanism, disposed on the chassis body, and fixedly connected to the other end of the second pull cord, wherein in the case that the output shaft of the drive motor drives the winding mechanism to rotate along a second direction, the second pull cord is pulled such that the chassis lift mechanism is adjustable.

In an optional embodiment, the chair further includes a handle fixed to the electrically controlled chassis, wherein the handle is internally provided with a wireless signal transmitter device, a switch electrically connected to the wireless signal transmitter device being disposed on an outer wall of the handle.

In an optional embodiment, the electrically controlled chassis further includes a wireless signal receiver device, wherein the wireless signal receiver device is disposed in the accommodation space of the electrical control box and electrically connected to the drive motor, and configured to receive a wireless control signal to control operation of the drive motor.

In an optional embodiment, the winding mechanism is provided with a rotation shaft, a baffle being sleeved onto the rotation shaft, the baffle being provided with an opening; wherein a throughbeam photoelectric sensor corresponding to a position of the baffle is disposed in the accommodation space of the electrical control box, the throughbeam photoelectric sensor operates via the opening, and configured to output a control signal to the drive motor.

In an optional embodiment, the chassis lift mechanism includes a pneumatic rod and a rotation stopper, one end of the pneumatic rod being provided with a key valve, and one end of the rotation stopper being rotatably connected to the chassis body, and the other end of the rotation stopper being connected to the second pull cord;

wherein in the case that the drive motor drives the second pull cord to move, the second pull cord pulls the rotation stopper to rotate, such that rotation stopper presses the key valve to cause the pneumatic rod to move upward and downward.

In an optional embodiment, the chair includes a handle fixed to the electrically controlled chassis, wherein the handle is internally provided with a wireless signal transmitter device, a switch electrically connected to the wireless signal transmitter device being disposed on an outer wall of the handle.

According to the embodiments of the present disclosure, the electrically controlled chassis is provided with only one drive motor, the first pull cord and the second pull cord are reversely wound on the winding mechanism, forward rotation and reverse rotation of the output shaft of the drive motor respectively drive the winding mechanism to rotate along the first direction or the second direction, such that the first pull cord is only pulled or the second pull cord is only pulled. In this way, the backrest adjustment mechanism is adjusted or the chassis lift mechanism is adjusted. This simplifies the structure for electrically controlling the chassis of the chair, saves space, and effectively reduces production cost. In addition, the electrical control structure is simple and easy to operate.

The above description only summarizes the technical solutions of the present disclosure. Specific embodiments of the present disclosure are described hereinafter to better and clearer understand the technical solutions of the present disclosure, to practice the technical solutions based on the disclosure of the specification and to make the above and other objectives, features and advantages of the present disclosure more apparent and understandable.

BRIEF DESCRIPTION OF THE DRAWINGS

By reading the detailed description of preferred embodiments hereinafter, various other advantages and beneficial effects become clear and apparent for persons of ordinary skill in the art. The accompanying drawings are merely for illustrating the preferred embodiments, but shall not be construed as limiting the present disclosure. In all the accompanying drawings, like reference numerals denote like parts. In the drawings.

REFERENCE NUMERALS IN THE EMBODIMENTS AND DENOTATIONS THEREOF

100—electrically controlled chassis, 110—chassis body, 111—holder, 112—backrest support, 113—manually controlled handle, 120—electrical control box, 130—drive motor, 131—output shaft, 140—winding mechanism, 141—rotation shaft, 142—baffle, 1421—opening, 143—throughbeam photoelectric sensor, 150—first pull cord, 160—second pull cord, 170—wireless signal receiver device, 181—pneumatic rod, 182—key valve, 183—rotation stopper, 1831—hinge end, 1832—force receiving end, 184—urging direction adjuster, 1841—catch groove, 1842—wheel, 191—catch block, 192—locking slider, 1921—first elastic member, 1922—first rack, 193—elastic slider, 1931—second rack, 1932—second inclined edge, 194—second elastic member, 195—active slider, 1951—first inclined edge, 196—third elastic member, 200—transmission mechanism, 210—third pull cord, 220—fourth pull cord, 300—battery, 400—battery accommodation structure, 10—chair, 11—handle, and 12—switch.

DETAILED DESCRIPTION

The embodiments containing the technical solutions of the present disclosure are described in detail with reference to the accompanying drawings. The embodiments hereinafter are only used to clearly describe the technical solutions of the present disclosure. Therefore, these embodiments are only used as examples, but are not intended to limit the protection scope of the present disclosure.

According to one aspect of the embodiments of the present disclosure, an electrically controlled chassis is provided. The electrically controlled chassis is applicable to adjustment of a chair to simplify an adjustment mechanism for lift adjustment of the chassis of the chair and pitch adjustment of a backrest of the chair, and improve operation convenience.

Figure 1:
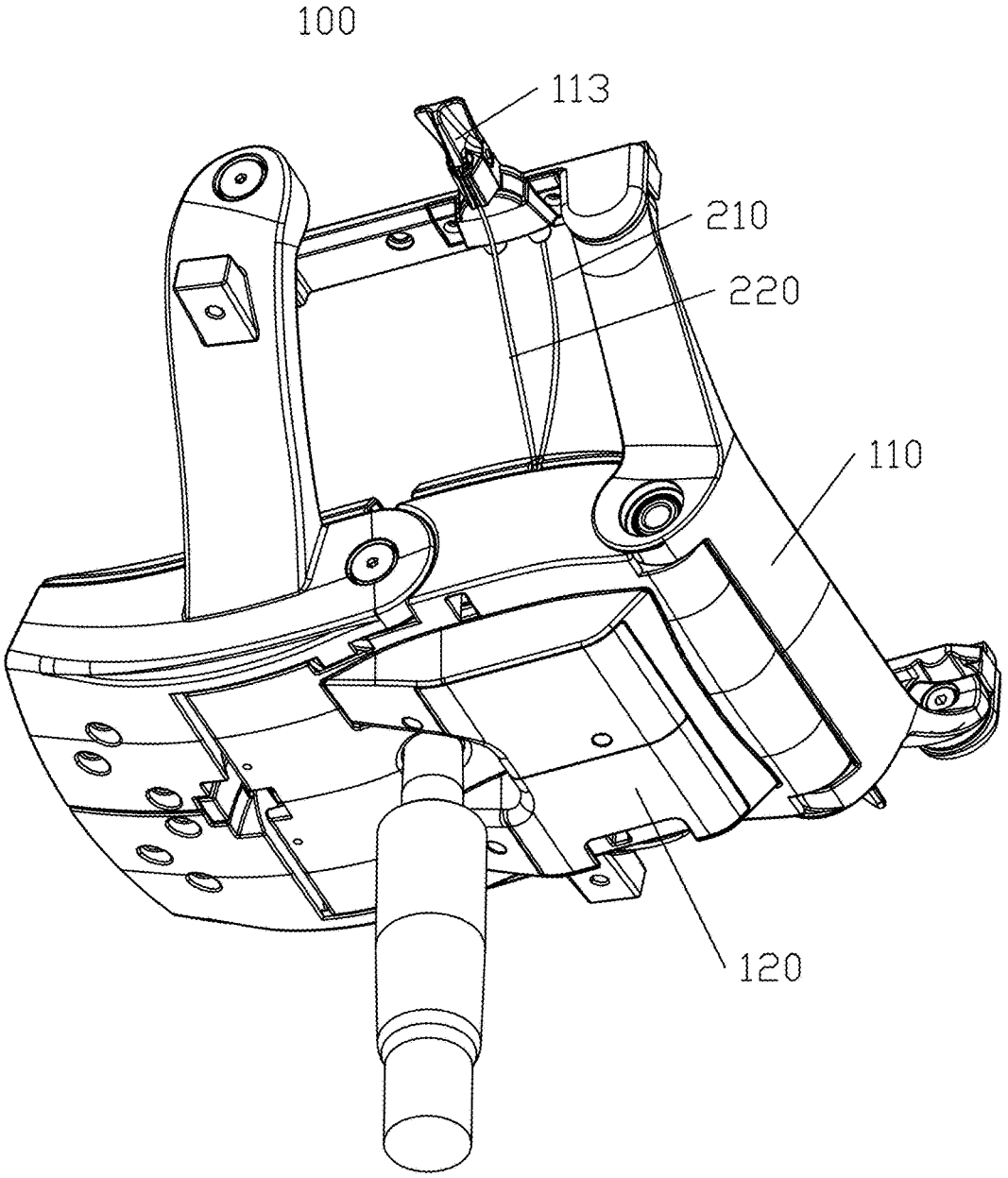
FIG. 1 is a schematic structural view of an electrically controlled chassis according to an embodiment of the present disclosure.
Figure 2:
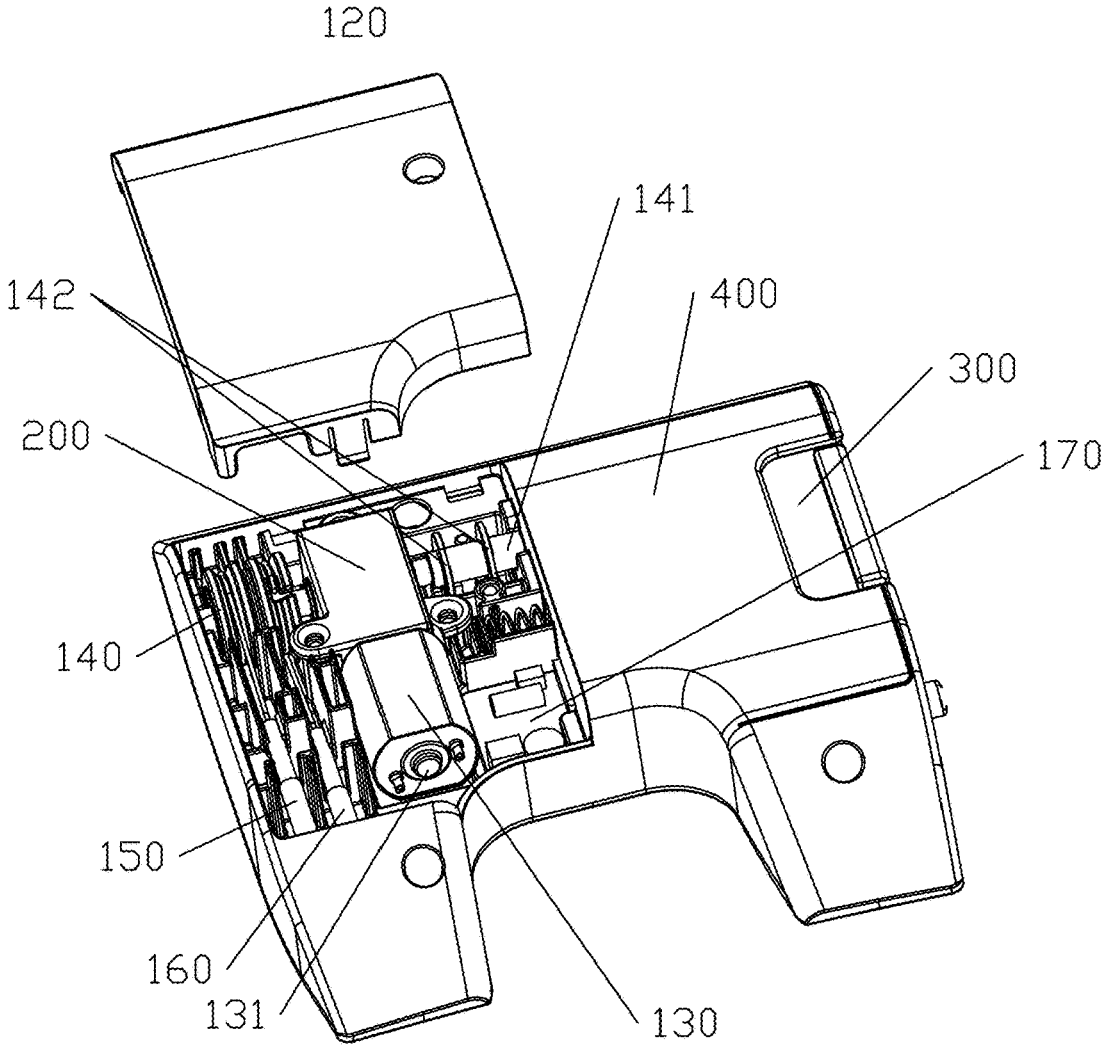
FIG. 2 is a schematic exploded structural view of an electrical control box in the electrically controlled chassis according to an embodiment of the present disclosure.

Referring to FIG. 1 to FIG. 2, a structure of an electrically controlled chassis and an exploded structure of an electrical control box in the electrically controlled chassis according to some embodiments of the present disclosure are illustrated.

As illustrated in the drawings, the electrically controlled chassis 100 includes: a chassis body 110, an electric control box 120, a drive motor 130, a winding structure 140, a first pull cord 150, a second pull cord 160, a backrest adjustment mechanism, and a chassis lift mechanism. The electrical control box 120 is disposed on the chassis body 110, and internally provided with an accommodation space. The drive motor 130 is disposed in the accommodation space of the electrical control box 120, and configured to control lift adjustment of the chassis of the chair and pitch adjustment of a backrest of the chair. The winding mechanism 140 is connected to an output shaft 131 of the drive motor 130, and rotatable with the output shaft 131 of the drive motor 130. The first pull cord 150 is reversely wound on the winding mechanism 140, and one end of the first pull cord 150 is fixedly connected to the winding mechanism 140. The second pull cord 160 is normally wound on the winding mechanism 140, and one end of the second pull cord 160 is fixedly connected to the winding mechanism 140. The backrest adjustment mechanism is disposed on the chassis body 110, and fixedly connected to the other end of the first pull cord 150, wherein in the case that the output shaft 131 of the drive motor 130 drives the winding mechanism 140 to rotate along a first direction, the first pull cord 150 is pulled such that the backrest adjustment mechanism is pitch adjustable. The chassis lift mechanism is disposed on the chassis body 110, and connected to the other end of the second pull cord 160, wherein in the case that the output shaft 131 of the drive motor 130 drives the winding mechanism 140 to rotate along a second direction, the second pull cord 160 is pulled such that the chassis lift mechanism is lift adjustable.

According to the embodiments of the present disclosure, the electrically controlled chassis 100 is provided with only one drive motor 130, the first pull cord 150 and the second pull cord 160 are reversely wound on the winding mechanism 140, forward rotation and reverse rotation of the output shaft 131 of the drive motor 130 respectively drive the winding mechanism 140 to rotate along the first direction or the second direction, such that the first pull cord 150 is only pulled or the second pull cord 160 is only pulled. In this way, the backrest adjustment mechanism is adjusted or the chassis lift mechanism is adjusted. This simplifies the structure for electrically controlling the chassis of the chair, saves space, and effectively reduces production cost. In addition, the electrical control structure is simple and easy to operate.

Still referring to FIG. 2, in the specific embodiment as illustrated in FIG. 2, the output shaft 131 of the drive motor 130 may be rotatably connected to the winding mechanism 140 via the transmission mechanism 200. The transmission mechanism 200 may be, for example, any combination of a worm, a turbine, a gear, and a bevel gear, to retard or accelerate the drive motor 130, and change the direction of a transmission shaft. To ensure normal operation of the drive motor 130, the electrical control box 120 may be provided with a battery accommodation structure 400 configured to accommodate a battery 300.

A person skilled in the art shall understand that the illustrations in the drawings are merely exemplary, and in other embodiments, the winding mechanism 140 may also be directly sleeved onto the output shaft 131 of the drive motor 130, and rotation of the output shaft 131 of the drive motor 130 directly drives the winding mechanism 140 to rotate.

Still referring to FIG. 2, in some embodiments, the electrically controlled chassis 100 may further include a wireless signal receiver device 170. The wireless signal receiver device 170 is disposed in the accommodation space of the electrical control box 120 and electrically connected to the drive motor 130, and is configured to receive a wireless control signal to control operation of the drive motor 130.

By configuring the wireless signal receiver device 170, the backrest adjustment mechanism and the chassis lift mechanism may be remotely controlled. For example, the chair may be adjusted by remotely controlling a terminal to send the wireless control signal. In addition, configuration of the wireless signal receiver device 170 also enables a control switch on the electrically controlled chassis 100 or the chair to control the drive motor 130 in the electrical control box 120 based on a wireless signal, such that electrically connected conductive wires inside the electrically controlled chassis 100 are not needed and the structure of the electrically controlled chassis 100 is further simplified. This saves a hollow wiring space inside the chassis, and effectively improves stability of the structure of the electrically controlled chassis 100.

Still referring to FIG. 2, in the specific embodiment as illustrated in FIG. 2, the wireless signal receiver device 170 may be disposed on a circuit board to implement the function of receiving the wireless signal.

Figure 3:
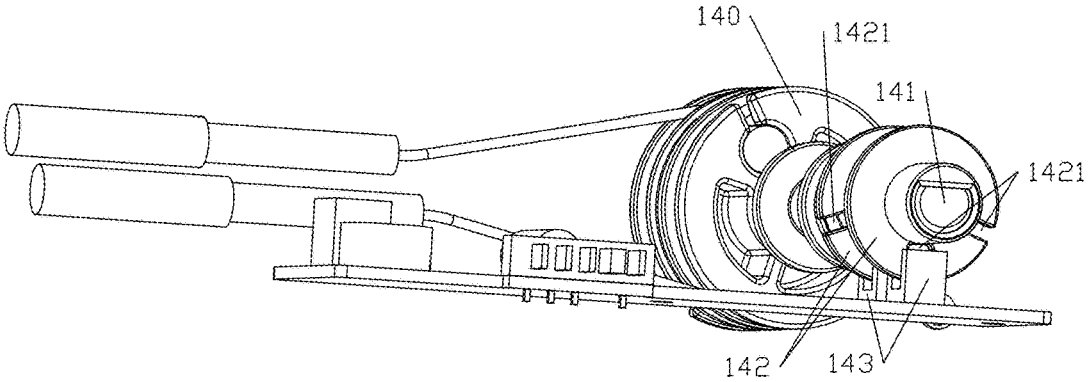
FIG. 3 is a schematic structural view of a baffle and a throughbeam photoelectric sensor in the electrically controlled chassis according to an embodiment of the present disclosure.

Referring to FIG. 2 and FIG. 3, in some embodiments, the winding mechanism 140 is provided with a rotation shaft 141. A baffle 142 is sleeved onto the rotation shaft 141. The baffle 142 is provided with an opening 1421. A throughbeam photoelectric sensor 143 corresponding to the position of the baffle 142 is disposed in the accommodation space of the electrical control box 120. The throughbeam photoelectric sensor 143 operates via the opening 1421 and outputs a control signal to the drive motor 130.

By configuring the baffle 142 and the throughbeam photoelectric sensor 143, a rotation stroke of the drive motor 130 is controlled, such that a case where the pull cords are broken due to an over-great rotation stroke of the output shaft 131 of the drive motor 130 is prevented.

Still referring to FIG. 3, in the specific embodiment as illustrated in FIG. 3, two baffles 142 and two throughbeam photoelectric sensors 143 are configured in two sets. One set is configured to control a forward rotation stroke of the rotation shaft 141, and the other set is configured to control a reverse rotation stroke of the rotation shaft 141.

Figure 4:
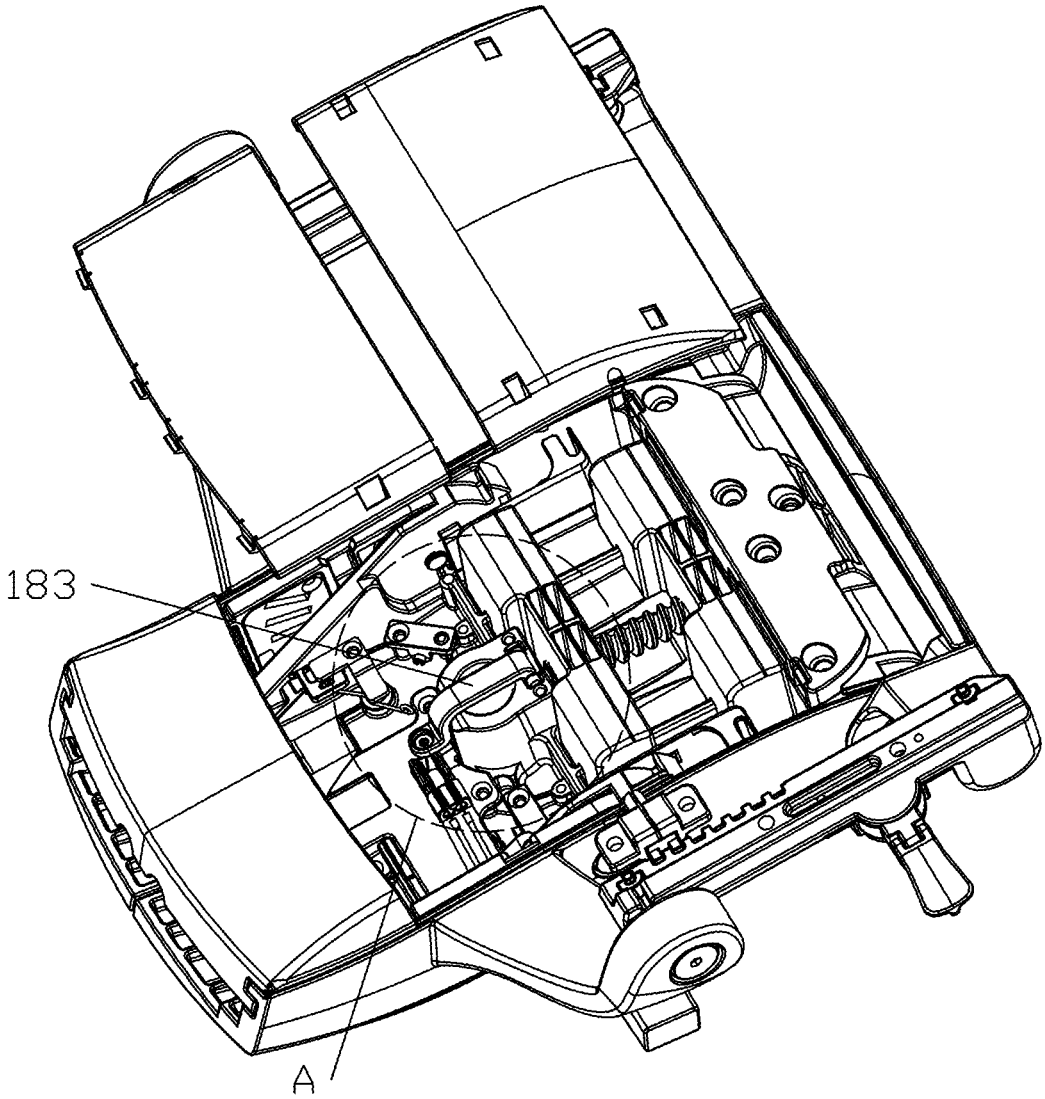
FIG. 4 is a schematic exploded structural view from a view angle of the electrically controlled chassis according to an embodiment of the present disclosure.
Figure 5:
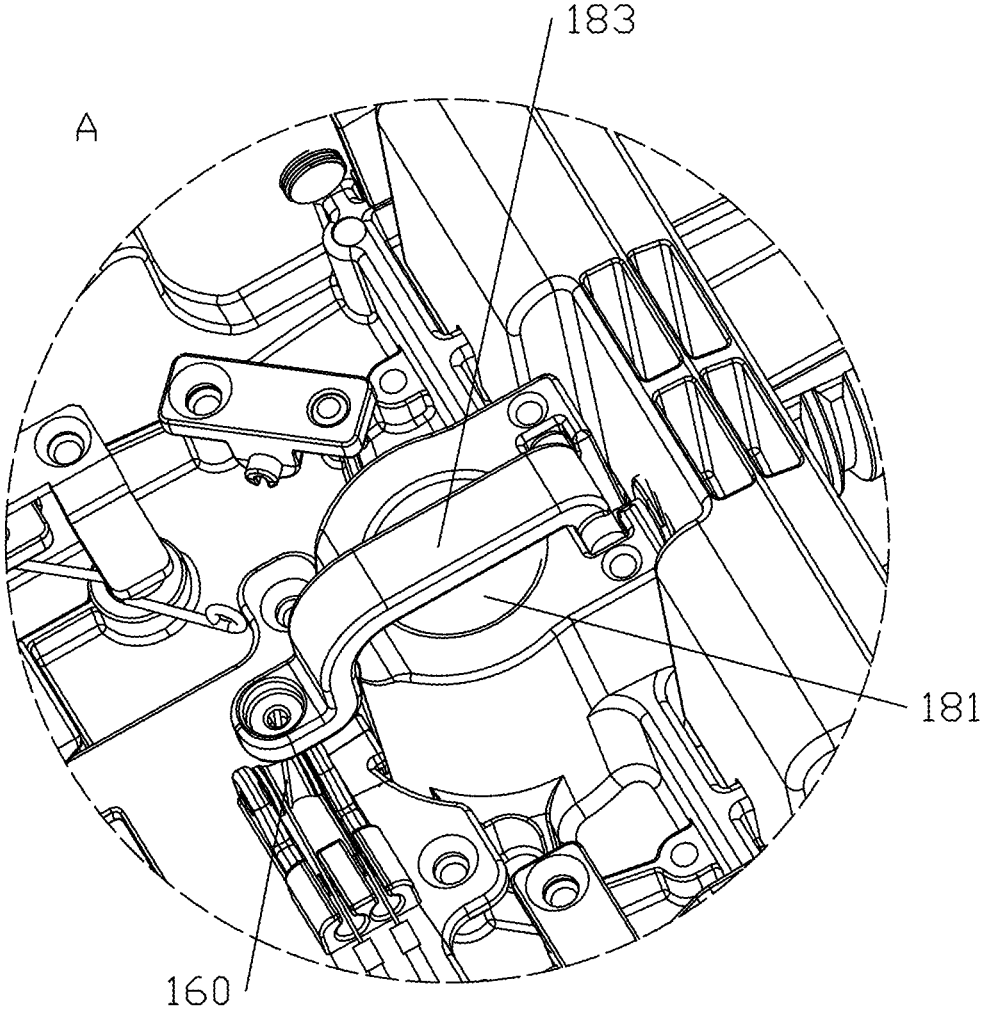
FIG. 5 is a schematic partial enlarged view of part A in FIG. 4.
Figure 6:
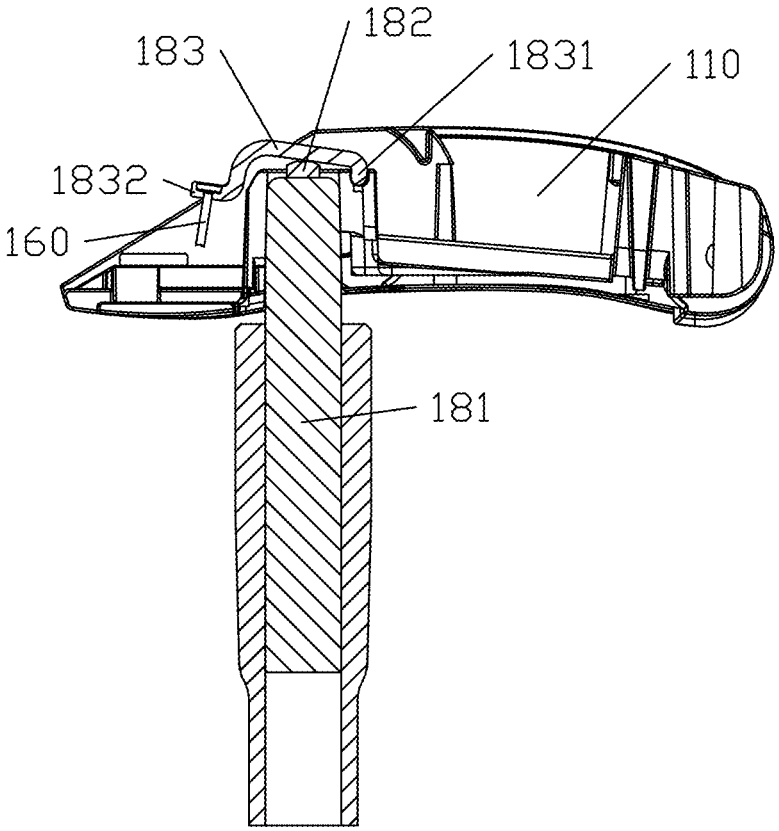
FIG. 6 is a schematic sectional view of fitting between a pneumatic rod and a rotation stopper in the electrically controlled chassis according to an embodiment of the present disclosure.

Referring to FIG. 4 to FIG. 6, a structure of the chassis lift mechanism in the electrically controlled chassis 100 according to an embodiment of the present disclosure is schematically illustrated. In some embodiments, the chassis lift mechanism includes a pneumatic rod 181 and a rotation stopper 183. One end of the pneumatic rod 181 is provided with a key valve 182. One end of the rotation stopper 183 is connected to the chassis body, and the other end of the rotation stopper 183 is connected to the second pull cord 160. In the case that the drive motor drives the second pull cord 160 to rotate, the second pull cord 160 drives the rotation stopper 183 to rotate, such that the rotation stopper 183 presses the key valve 183, causing the pneumatic rod 181 to move upward and downward.

Still referring to FIG. 6, in the specific embodiment as illustrated in FIG. 6, the rotation stopper 183 is provided with a hinge end 1831 rotatably connected to the chassis body 110, and a force receiving end 1832 fixedly connected to the second pull cord 160. During use, in the case that the drive motor 130 operates and reversely rotates, the second pull cord 160 is pulled, the force receiving end 1832 is driven to move, and the rotation stopper 183 rotates counterclockwise relative to the chassis body 110 through the hinge end 1831, such that the rotation stopper 183 presses the key valve 182; and in the case that the chassis body 110 does not suffer from any external force or suffers from an external force less than a force for the pneumatic rod 181 to automatically lift and restore, the pneumatic rod 181 automatically lifts and restores, and jacks the chassis body 110, thereby implementing lift adjustment of the chair. In the case that the drive motor 130 operates and reversely rotates, the second pull cord 160 is pulled, the force receiving end 1832 is driven to move, and the rotation stopper 183 rotates counterclockwise relative to the chassis body 110 through the hinge end 1831, such that the rotation stopper 183 presses the key valve 182. In this case, when a human body is seated on the chair, and a downward gravity of the human body is greater than the force for the pneumatic rod 181 to automatically lift and restore, the pneumatic rod 181 is pressed and slides, thereby implementing fall adjustment of the chair.

Figure 7:
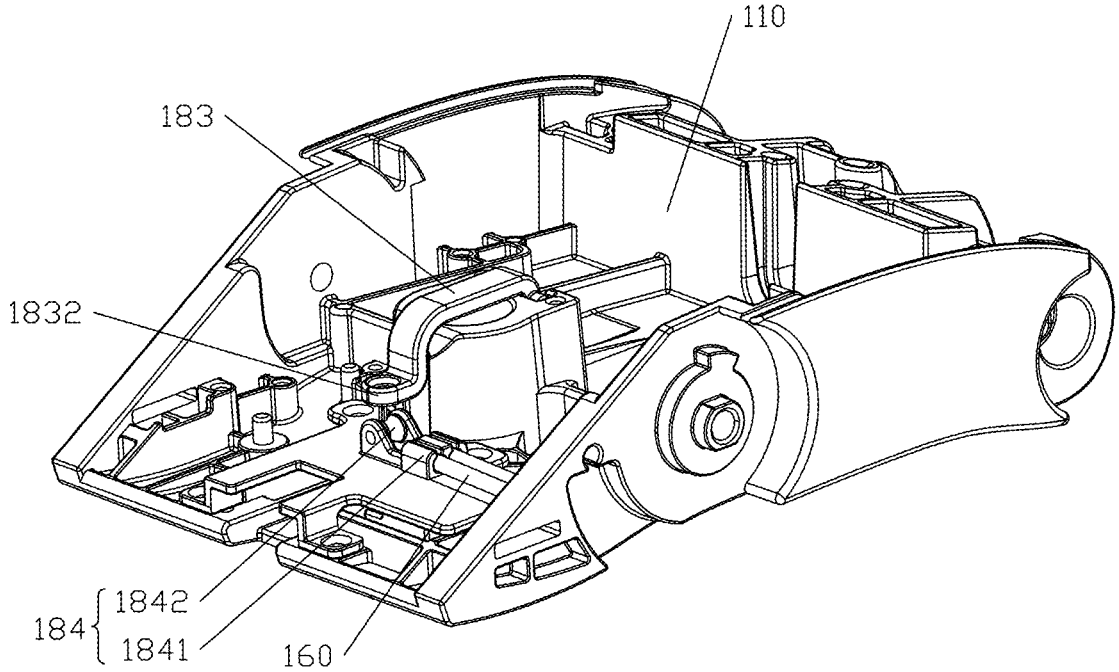
FIG. 7 is a schematic structural view of fitting between an urging direction adjuster and the rotation stopper in the electrically controlled chassis according to an embodiment of the present disclosure.

Referring to FIG. 7, a structure of an urging direction adjuster in the electrically controlled chassis according to an embodiment of the present disclosure is schematically illustrated. In some embodiments, the chassis lift mechanism further includes an urging direction adjuster 184. The urging direction adjuster 184 is disposed at a position, corresponding to the rotation stopper 183, on the chassis body 110; the second pull cord 160 penetrates the urging direction adjuster 184; and the urging direction adjuster 184 is configured to adjust a movement direction of the second pull cord 160 to be consistent with a tangential direction of a rotation direction of the rotation stopper 183.

By configuring the urging direction adjuster 184, a direction of a pull force applied by the second pull cord 160 on the rotation stopper 183 is constantly tangential to a circle of rotation trajectory of the rotation stopper 183, such that an effective pull force applied by the second pull cord 160 on the rotation stopper 183 is the maximum. In this way, the rotation stopper 183 may be more conveniently pulled.

Still referring to FIG. 7, in some embodiments, the urging direction adjuster 184 is provided with a catch groove 1841 and a wheel 1842. The wheel 1842 is disposed opposite to the rotation stopper 183. The second pull cord 160 is clamped into the catch groove 1841, and wound on the wheel 1842.

Still referring to FIG. 7, in the specific embodiment as illustrated in FIG. 7, the wheel 1842 is disposed at an orthographic projection of the force receiving end 1832 on the chassis body, and the second pull cord 160 is clamped into the catch groove 1841 and wound on the wheel 1842. In the case that the drive motor rotates, the second pull cord 160 is driven to move along a direction parallel to the chassis body 110. In the case that the second pull cord 160 travels through the urging direction adjuster 184, the movement direction of the second pull cord 160 is adjusted to a direction tangential to the circle of rotation trajectory of the force receiving end 1832, such that the second pull cord 160 pulls the force receiving end 1832 to move.

Figure 8:
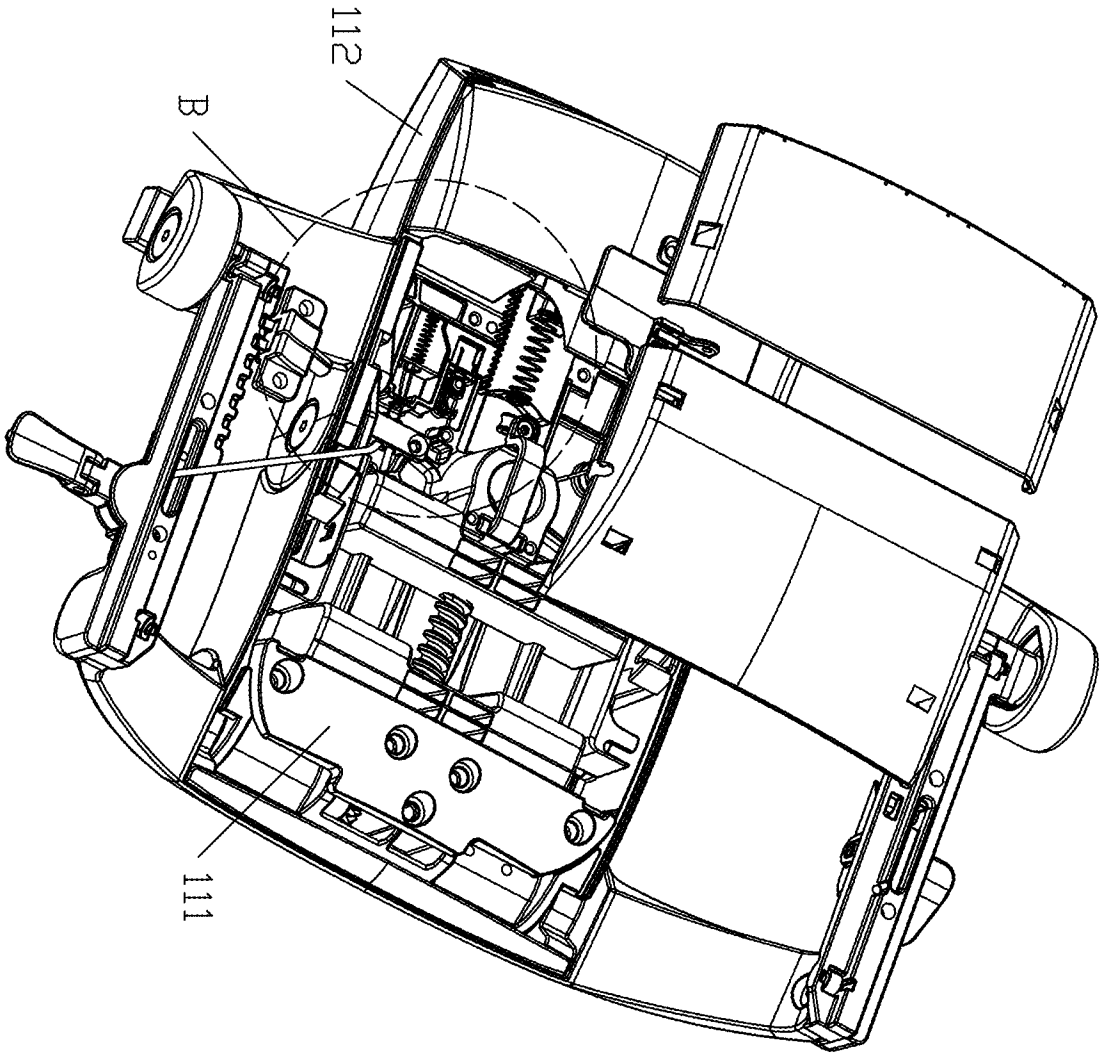
FIG. 8 is a schematic exploded structural view from another view angle of the electrically controlled chassis according to an embodiment of the present disclosure.
Figure 9:
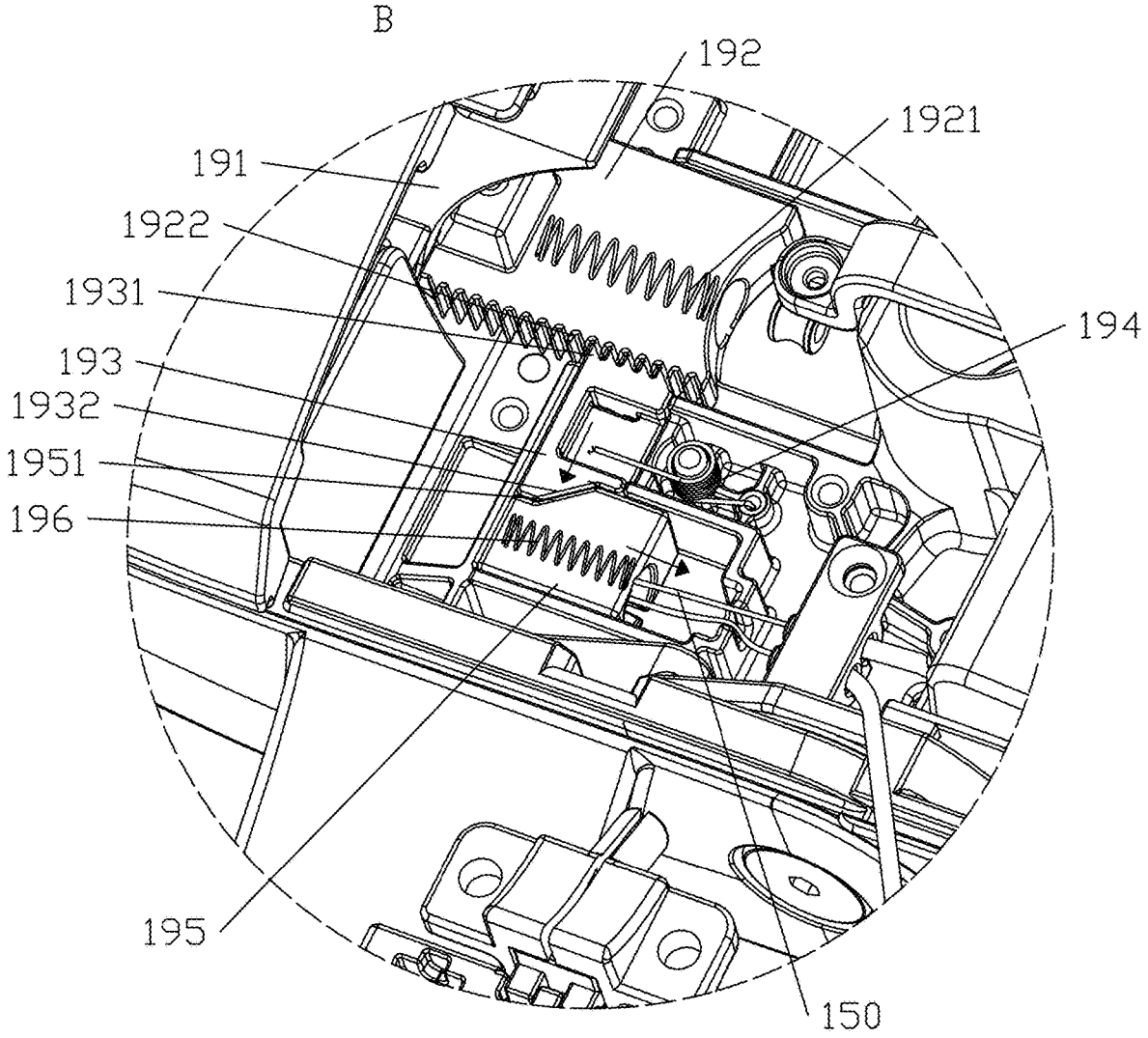
FIG. 9 is a schematic partial enlarged view of part B in FIG. 8.
Figure 10:
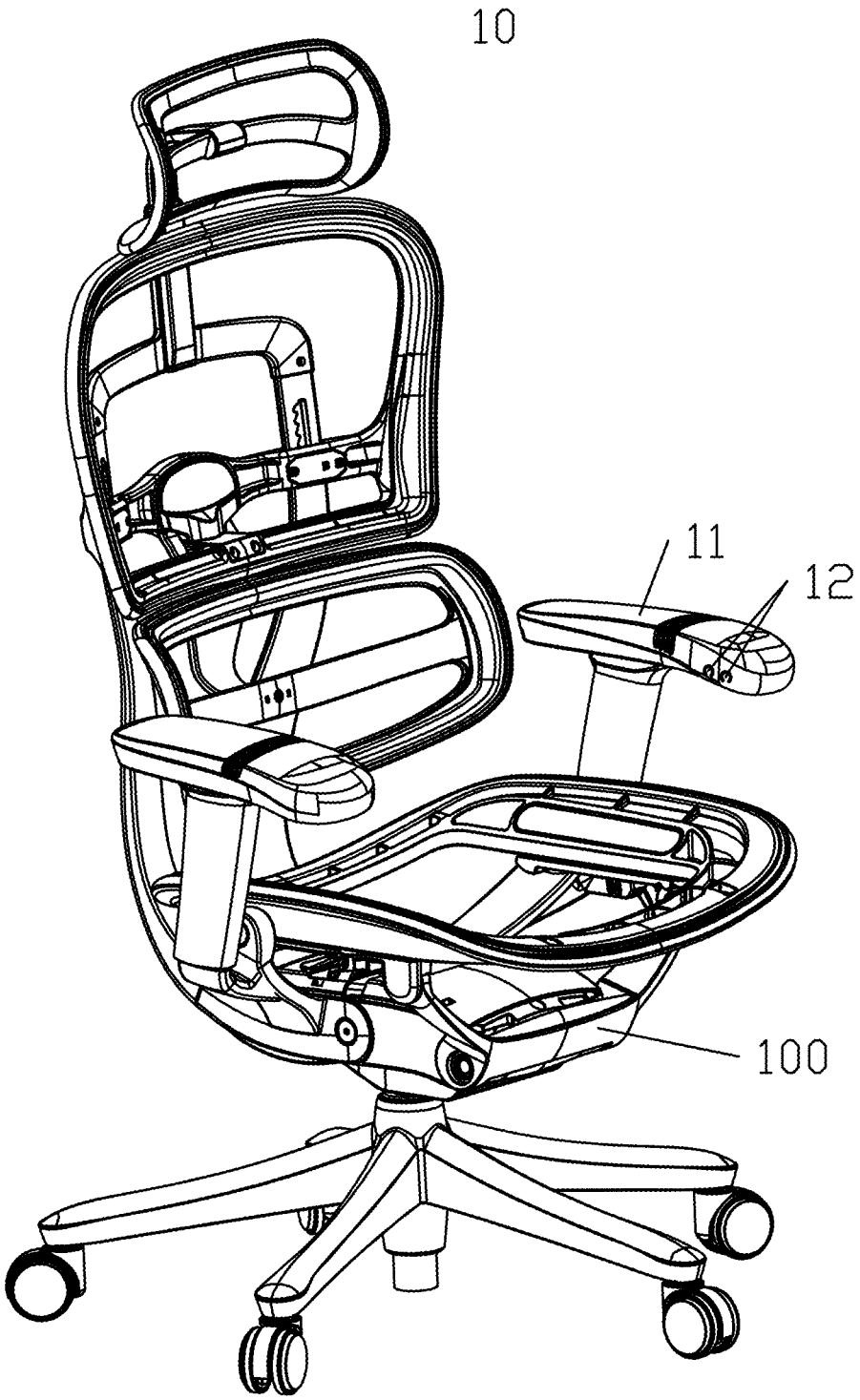
FIG. 10 is a schematic structural view of a chair according to an embodiment of the present disclosure.

Referring to FIG. 8 and FIG. 9, a structure of a backrest adjustment mechanism in the electrically controlled chassis 100 according to an embodiment of the present disclosure is illustrated. In some embodiments, the chassis body may include a holder 111 and a backrest support 112 rotatably connected to the holder 111, and the backrest adjustment mechanism includes a catch block 191, a locking slider 192, and a first elastic member 1921. The catch block 191 is disposed on the backrest support 112. One end of the first elastic member 1921 is connected to the holder 111, and the other end of the first elastic member 1921 is connected to the locking slider 192, and configured to supply an elastic force for sliding towards the catch block 191 to the locking slider 192. The locking slider 192 is in limiting fit with the catch block 191, and configured to limit and adjust the backrest support 112.

By limiting fit between the locking slider 192 and the catch block 191, rotation of the backrest support 112 is limited and fixed.

Still referring to FIG. 8 and FIG. 9, in some embodiments, the backrest adjustment mechanism may further include an elastic slider 193 and a second elastic member 194 (for example, a torsion spring as illustrated in FIG. 5). The elastic slider 193 is slidably disposed on the holder 111. One side of the locking slider 192 is provided with a first rack 1922. One end of the elastic slider 193 is provided with a second rack 1931. The elastic slider 193 locks and limits the locking slider 192 under meshing between the second rack 1931 on the elastic slider and the first rack 1922 on the locking slider 192. One end of the second elastic member 194 is disposed on the holder 111, and the other end of the second elastic member 194 is connected to the elastic slider 193, and configured to drive the elastic slider 193 to slide to detach from the locking slider 192.

By meshing between the second rack 1931 on the elastic slider 193 and the first rack 1922 on the locking slider 192, the locking slider 192 is slidably fixed, such that the locking slider 192 limits and fixes the catch block 191, and thus rotation of the backrest support 112 is limited.

Still referring to FIG. 8 and FIG. 9, in some embodiments, the backrest adjustment mechanism may further include an active slider 195 and a third elastic member 196. The active slider 195 is slidably disposed on the holder 111 and provided with a first inclined edge 1951, and the elastic slider 193 is provided with a second inclined edge 1932; one end of the active slider 195 is connected to one end of the third elastic member 196, and the other end of the active slider 195 is connected to the first pull cord 150. The other end of the third elastic member 196 is connected to the holder 111, and configured to supply an elastic force for sliding towards the elastic slider 193 to the active slider 195. In the case that the first pull cord 150 pulls the active slider 195 to slide (a slide direction is as indicated by the arrow marked on the active slider 195 in FIG. 9), the first inclined edge 1951 of the active slider 195 detaches from the second inclined edge 1932 of the elastic slider 193, and the elastic slider 193 slides towards the active slider 195 under action of the second elastic member 194, such that the second rack 1931 on the elastic slider 193 detaches from the first rack 1922 on the locking slider 192.

By configuring the active slider 195, the direction of the pull force applied by the first pull cord 150 is effectively optimized, such that the active slider 195 is conveniently pulled by the first pull cord 150, thereby facilitating easier unlocking of the locking slider 192.

Still referring to FIG. 1, in some embodiments, the chassis body 110 is provided with a manually controlled handle 113. The manually controlled handle 113 is connected to the backrest adjustment mechanism and the chassis lift mechanism by a third pull cord 210 and a fourth pull cord 220, and configured to control pitch of the backrest adjustment mechanism and lift of the chassis.

By configuring the manually controlled handle 113, the backrest adjustment mechanism and the chassis lift mechanism are electrically controlled, and may also be manually controlled separately, which is more convenient for the operation and control of the backrest adjustment mechanism and the chassis lift mechanism.

According to another aspect of the embodiments of the present disclosure, a chair is provided.

Referring to FIG. 9, a structure of a chair according to an embodiment of the present disclosure is schematically illustrated. As illustrated in FIG. 9, the chair 10 includes an electrically controlled chassis 100.

Still referring to FIG. 9, in some embodiments, the chair 10 may further include a handle 11 fixed to the electrically controlled chassis 100. The handle 11 is internally provided with a wireless signal transmitter device. A switch 12 electrically connected to the wireless signal transmitter device is disposed on an outer wall of the handle 11.

By configuring the switch 12 on the handle 11 for the chair 10 according to the embodiments of the present disclosure, the wireless signal transmitter device is controlled by the switch 12 to send the wireless control signal to the wireless signal receiver device in the electrically controlled chassis 100, such that convenient electrically controlled adjustment for pitch of the backrest and lift of the chassis in the chair 10 is achieved.

It should be noted that unless otherwise specified, the technical terms and scientific terms used in the present disclosure shall express general meanings that may be understood by a person skilled in the art.

In the description of the embodiments of the present disclosure, it should be understood that the terms "central," "transversal," "longitudinal," "length," "width," "thickness," "upper," "lower," "front," "rear," "left," "right," "vertical," "horizontal," "top," "bottom," "inner," "outer," "clockwise," "counterclockwise," "axial," "radial," "circumferential," and the like indicate orientations and position relationships which are based on the illustrations in the accompanying drawings, and these terms are merely for ease and brevity of the description, instead of indicating or implying that the devices or elements shall have a particular orientation and shall be structured and operated based on the particular orientation. Accordingly, these terms shall not be construed as limiting the present disclosure.

In addition, terms of "first," "second," and the like are only used for description, but shall not be understood as indication or implication of relative importance or implicit indication of the number of the specific technical features. In the description of the embodiments of the present disclosure, the term "more" or "a plurality of" signifies at least two, unless otherwise specified.

In the description of the embodiments of the present disclosure, it should be noted that unless otherwise specified and defined, the terms "mounted," "coupled," "connected," "fixed," and derivative forms thereof shall be understood in a broad sense, which, for example, may be understood as fixed connection, detachable connection or integral connection; may be understood as mechanical connection or electrical connection, or understood as direct connection, indirect connection via an intermediate medium, or communication between the interiors of two elements or interactions between two elements. Persons of ordinary skill in the art may understand the specific meanings of the above terms in the embodiments of the present disclosure according to the actual circumstances and contexts.

In the description of the embodiments of the present disclosure, unless otherwise specified or defined, by defining that a first feature is arranged "above," or "below," or "beneath" a second feature, it means that the first feature is in direct contact with the second feature, or the first feature is in indirect contact with the second feature via an intermediate medium. In addition, by defining that a first feature is arranged "over," "above," and "under" a second feature, it means that the first feature is rightly over the second feature or is obliquely above the second feature, or the horizontal height of the first feature is greater than that of the second feature. In addition, by defining that a first feature is arranged "under," or "below," or "beneath" a second feature, it means that the first feature is rightly under the second feature or is obliquely below the second feature, or the horizontal height of the first feature is less than that of the second feature.

It should be finally noted that the above-described embodiments are merely for illustration of the present disclosure, but are not intended to limit the present disclosure. Although the present disclosure is described in detail with reference to these embodiments, a person skilled in the art may also make various modifications to the technical solutions disclosed in the embodiments, or make equivalent replacements to a part of or all technical features contained therein. Such modifications or replacement, made without departing from the principles of the present disclosure, shall fall within the scope defined by the claims and the specification of the present disclosure. Especially, various technical features mentioned in various embodiments may be combined in any fashion as long as there is no structural conflict. The present disclosure is not limited to the specific embodiments described herein in this specification, but also includes all the technical solutions falling within the scope subject to the appended claims.

What is claimed is:

1. An electrically controlled chassis, applicable to adjustment of a chair, the electrically controlled chassis comprising:

a chassis body;

an electrical control box, disposed on the chassis body, and internally provided with an accommodation space;

a drive motor, disposed in the accommodation space of the electrical control box, and configured to control lift adjustment of the chassis of the chair and pitch adjustment of a backrest of the chair;

a winding mechanism, connected to an output shaft of the drive motor, and being rotatable with the output shaft of the drive motor;

a first pull cord, wound on the winding mechanism along a first direction, and one end of the first pull cord being fixedly connected to the winding mechanism;

a second pull cord, wound on the winding mechanism along a second direction, and one end of the second pull cord being fixedly connected to the winding mechanism;

wherein the first direction and the second direction are opposite directions;

a backrest adjustment mechanism, disposed on the chassis body, and fixedly connected to the other end of the first pull cord, wherein when the output shaft of the drive motor drives the winding mechanism to rotate along a first direction, the first pull cord is pulled such that the backrest adjustment mechanism is adjustable; and a chassis lift mechanism, disposed on the chassis body, and fixedly connected to the other end of the second pull cord, wherein when the output shaft of the drive motor drives the winding mechanism to rotate along a second direction, the second pull cord is pulled such that the chassis lift mechanism is adjustable.

2. The electrically controlled chassis according to claim 1, further comprising a wireless signal receiver device, wherein the wireless signal receiver device is disposed in the accommodation space of the electrical control box and electrically connected to the drive motor, and configured to receive a wireless control signal to control operation of the drive motor.

3. The electrically controlled chassis according to claim 1, wherein the winding mechanism is provided with a rotation shaft, a baffle being sleeved onto the rotation shaft, the baffle being provided with an opening;

wherein a throughbeam photoelectric sensor corresponding to a position of the baffle is disposed in the accommodation space of the electrical control box, the throughbeam photoelectric sensor operates via the opening, and configured to output a control signal to the drive motor.

4. The electrically controlled chassis according to claim 1, wherein the chassis lift mechanism comprises a pneumatic rod and a rotation stopper, Ilona a first end of the pneumatic rod being provided with a key valve, and a first end of the rotation stopper being rotatably connected to the chassis body, and the other a second end of the rotation stopper being connected to the second pull cord;

wherein when the drive motor drives the second pull cord to move, the second pull cord pulls the rotation stopper to rotate, such that rotation stopper presses the key valve to cause the pneumatic rod to move upward and downward.

5. T The electrically controlled chassis according to claim 4, wherein the rotation stopper is provided with a hinge end rotatably connected to the chassis body, and a force receiving end fixedly connected to the second pull cord.

6. The electrically controlled chassis according to claim 4, wherein the chassis lift mechanism further comprises an urging direction adjuster; wherein the urging direction adjuster is disposed at a position, corresponding to the rotation stopper, on the chassis body, and the second pull cord penetrates the urging direction adjuster; and the urging direction adjuster is configured to adjust a movement direction of the second pull cord to be consistent with a tangential direction of a rotation direction of the rotation stopper.

7. He electrically controlled chassis according to claim 6, wherein the urging direction adjuster is provided with a catch groove and a wheel, the wheel being disposed opposite to the rotation stopper;

wherein the second pull cord is clamped into the catch groove, and wound on the wheel.

8. The electrically controlled chassis according to claim 7, wherein the wheel is disposed at an orthographic projection of the force receiving end on the chassis body, and the second pull cord is clamped into the catch groove and wound on the wheel.

9. The electrically controlled chassis according to claim 1, wherein the chassis body comprises a holder and a backrest support rotatably connected to the holder, and the backrest adjustment mechanism comprises a catch block, a locking slider, and a first elastic member; wherein the catch block is disposed on the backrest support;

a first end of the first elastic member is connected to the holder, and a second end of the first elastic member is connected to the locking slider, and configured to supply an elastic force for sliding towards the catch block to the locking slider; and the locking slider is in limiting fit with the catch block, and configured to limit and adjust the backrest support.

10. The electrically controlled chassis according to claim 9, wherein the backrest adjustment mechanism further comprises an elastic slider and a second elastic member; wherein the elastic slider is slidably disposed on the holder;

one side of the locking slider is provided with a first rack, one end of the elastic slider is provided with a second rack, and the elastic slider locks and limits the locking slider under meshing between the second rack on the elastic slider and the first rack on the locking slider; and a first end of the second elastic member is disposed on the holder, and a second end of the second elastic member is connected to the elastic slider, and configured to drive the elastic slider to detach from the locking slider.

11. The electrically controlled chassis according to claim 10, wherein the backrest adjustment mechanism further comprises an active slider and a third elastic member; wherein the active slider is slidably disposed on the holder and provided with a first slant edge, and the elastic slider is provided with a second slant edge;

a first end of the active slider is connected to a first end of the third elastic member, and a second end of the active slider is connected to the first pull cord;

a second end of the third elastic member is connected to the holder, and configured to supply an elastic force for sliding towards the elastic slider to the active slider; and when the first pull cord pulls the active slider to slide, the first slant edge of the active slider detaches from the second slant edge of the elastic slider, and the elastic slider slides towards the active slider under action of the second elastic member, such that the second rack on the elastic slider detaches from the first rack on the locking slider.

12. The electrically controlled chassis according to claim 1, wherein the chassis body is provided with a manually controlled handle, wherein the manually controlled handle is connected to the backrest adjustment mechanism and the chassis lift mechanism by a third pull cord and a fourth pull cord, and configured to control the backrest adjustment mechanism and the chassis lift mechanism.

13. The electrically controlled chassis according to claim 1, wherein the output shaft of the drive motor is rotatably connected to the winding mechanism via the transmission mechanism.

14. The electrically controlled chassis according to claim 13, wherein the transmission mechanism comprises one or a plurality of a worm, a turbine, a gear, and a bevel gear, to retard or accelerate the drive motor, and change the direction of a transmission shaft.

15. The electrically controlled chassis according to claim 1, wherein the electrical control box is provided with a battery accommodation structure configured to accommodate a battery.

16. A chair, comprising an electrically controlled chassis, wherein the electrically controlled chassis is applicable to adjustment of a chair, and the electrically controlled chassis comprising:

a chassis body;

an electrical control box, disposed on the chassis body, and internally provided with an accommodation space;

a drive motor, disposed in the accommodation space of the electrical control box, and configured to control lift adjustment of the chassis of the chair and pitch adjustment of a backrest of the chair;

a winding mechanism, connected to an output shaft of the drive motor, and being rotatable with the output shaft of the drive motor;

a first pull cord, wound on the winding mechanism along a first direction, and one end of the first pull cord being fixedly connected to the winding mechanism;

a second pull cord, wound on the winding mechanism along a second direction, and one end of the second pull cord being fixedly connected to the winding mechanism;

wherein the first direction and the second direction are opposite directions;

a backrest adjustment mechanism, disposed on the chassis body, and fixedly connected to the other end of the first pull cord, wherein when the output shaft of the drive motor drives the winding mechanism to rotate along a first direction, the first pull cord is pulled such that the backrest adjustment mechanism is adjustable; and a chassis lift mechanism, disposed on the chassis body, and fixedly connected to the other end of the second pull cord, wherein when the output shaft of the drive motor drives the winding mechanism to rotate along a second direction, the second pull cord is pulled such that the chassis lift mechanism is adjustable.

17. The chair according to claim 16, wherein the chair further comprises a handle fixed to the electrically controlled chassis, wherein the handle is internally provided with a wireless signal transmitter device, a switch electrically connected to the wireless signal transmitter device being disposed on an outer wall of the handle.

18. The chair according to claim 16, wherein the electrically controlled chassis further comprises a wireless signal receiver device, wherein the wireless signal receiver device is disposed in the accommodation space of the electrical control box and electrically connected to the drive motor, and configured to receive a wireless control signal to control operation of the drive motor.

19. The chair according to claim 16, wherein the winding mechanism is provided with a rotation shaft, a baffle being sleeved onto the rotation shaft, the baffle being provided with an opening;

wherein a throughbeam photoelectric sensor corresponding to a position of the baffle is disposed in the accommodation space of the electrical control box, the throughbeam photoelectric sensor operates via the opening, and configured to output a control signal to the drive motor.

20. The chair according to claim 16, wherein the chassis lift mechanism comprises a pneumatic rod and a rotation stopper, one end of the pneumatic rod being provided with a key valve, and a first end of the rotation stopper being rotatably connected to the chassis body, and a second end of the rotation stopper being connected to the second pull cord;

wherein when the drive motor drives the second pull cord to move, the second pull cord pulls the rotation stopper to rotate, such that rotation stopper presses the key valve to cause the pneumatic rod to move upward and downward.

* * * * *